United States Patent [19]

Manning

[11] Patent Number: 4,825,604

[45] Date of Patent: May 2, 1989

[54] GROUND ANCHOR

[75] Inventor: David J. Manning, Torrington, Wyo.

[73] Assignee: Helper Winch, Inc., Torrington, Wyo.

[21] Appl. No.: 137,420

[22] Filed: Dec. 22, 1987

[51] Int. Cl.[4] ..... E02D 5/80

[52] U.S. Cl. ..... 52/158; 52/155

[58] Field of Search ..... 52/155, 164, 162, 148, 52/166

[56] References Cited

U.S. PATENT DOCUMENTS

| | | | |
|---|---|---|---|
| 815,588 | 3/1906 | Hile . | |
| 905,215 | 12/1908 | Obinchain . | |
| 1,138,915 | 5/1915 | Wetzel . | |
| 1,268,459 | 6/1918 | Hjermstad . | |
| 1,427,889 | 9/1922 | Wittmann . | |
| 1,550,276 | 8/1925 | Nilsen | 52/158 |
| 2,163,808 | 6/1939 | Pithond | 52/158 |
| 2,191,124 | 2/1940 | Warmka | 52/158 |
| 2,784,815 | 3/1957 | Larson . | |
| 3,216,159 | 11/1965 | Rooker | 52/158 |
| 3,302,347 | 2/1967 | Jackson . | |
| 3,341,993 | 9/1967 | Larond | 52/158 |
| 3,500,598 | 3/1970 | Ettinger . | |
| 3,655,160 | 4/1972 | Grillot . | |
| 4,429,840 | 2/1984 | Maier | 52/155 |

FOREIGN PATENT DOCUMENTS

| | | | |
|---|---|---|---|
| 513290 | 4/1921 | France | 52/155 |
| 567815 | 3/1945 | United Kingdom | 52/155 |
| 749076 | 5/1950 | United Kingdom | 52/155 |

*Primary Examiner*—Henry E. Raduazo
*Assistant Examiner*—Caroline D. Dennison
*Attorney, Agent, or Firm*—Dean P. Edmundson

[57] ABSTRACT

A ground anchor is described for anchoring one end of a cable. The anchor includes an elongated stake member, attachment means on the front edge of the stake for attachment of one end of a cable, a support arm connected at one end to the upper end of the stake, and retention means on the opposite end of the support arm. The retention means holds down the cable when tension is applied. The support arm is preferably pivotable between an outward position for use and an inward position for storage and transport.

15 Claims, 2 Drawing Sheets

GROUND ANCHOR

FIELD OF THE INVENTION

This invention relates to anchors. More particularly, this invention relates to ground anchors. Even more particularly, this invention relates to ground anchors for temporarily anchoring one end of a cable, chain, rope, or other tension member.

BACKGROUND OF THE INVENTION

Ground anchors of various types have previously been described. See, for example, U.S. Pat. Nos. 815,588; 905,215; 1,138,915; 1,268,459; 1,427,889; 2,784,815; 3,302,347; 3,500,598 and 3,655,160. These types of anchors have been used for various purposes.

However, none of such previous types of anchors are very satisfactory for use in all situations. For example, some of such anchors are difficult to insert into the ground. Others are intended for use as more or less permanent anchoring (e.g., to anchor a guy wire used to support a telephone or power pole or large post). Still others are intended for light duty use where the force applied to the anchor is usually not very large.

There has not heretofore been provided an easy-to-use ground anchor which is adapted to firmly support a tension cable or the like in any type of ground and which can be easily and readily removed from the ground when desired.

SUMMARY OF THE PRESENT INVENTION

In accordance with the present invention there is provided a unique ground anchor which is readily stored and transported and which is easily driven into the ground when needed. In one embodiment the ground anchor of the invention comprises:

(a) an elongated stake member having upper and lower ends and front and rear edges; wherein the lower end includes a wing member projecting outwardly therefrom;

(b) attachement means carried by the front edge of the stake member between its upper and lower ends; the attachement means being adapted to connect to one end of a cable or the like;

(c) a support arm having first and second ends, wherein the first end is pivotally attached to the upper end of the stake member in a manner such that the support arm is pivotable between an inward position adjacent to the front edge of the stake member and an outward position away from the stake member; and (d) retention means carried by the second end of the support arm, the retention means being adapted to hold the cable downwardly when the cable is attached to the attachment means and tension is applied to the cable.

When the support arm is in its outward position and the lower end of the stake member is driven into the ground, the second end of the support arm is lower than the attachment means. As a result, when tension is applied to a cable attached to the stake member, the support arm urges the cable downwardly at a point near the stake so that pulling tension on the cable does not pull the anchor out of the ground. Rather, the pulling force on the cable helps keep the stake member firmly in the ground.

The ground anchor of this invention is very useful, for example, when used to anchor one end of a cable or the like (e.g., chain, rope, etc.) which is used in conjunction with a winch (e.g., a portable winch). The ground anchor can be inserted into various types of soil (e.g., firm soil, wet soil, sand, packed snow, etc.) where needed in order to anchor one end of a cable, and the anchor works surprisingly well even where the soil is wet or loose.

As a result, this ground anchor is especially useful when used to anchor a cable or the like which is being used to winch a vehicle out of or through mud, snow, sand, etc. For example, many vehicles include a power winch on the front thereof for the purpose of winching the vehicle when it is unable to progress under its own power. Also, there are portable power winches which can be used to winch items (e.g., vehicles, logs, game animals, etc.) across terrain. In such situations there is a need for an anchor to support one end of the pulling cable. The ground anchor of this invention is very useful in such situations.

Other advantages of the ground anchor of the invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
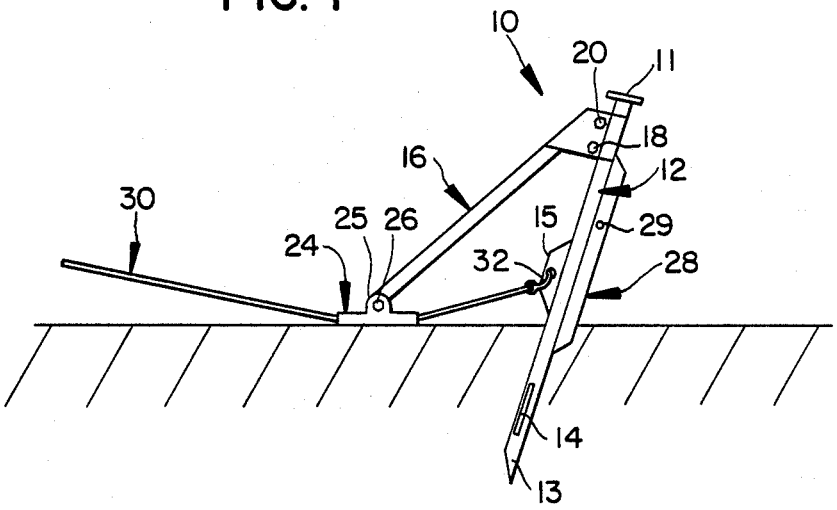
FIG. 1 is an elevational view illustrating the use of an anchor of this invention driven into the ground and anchoring one end of a cable.

In the drawings there is illustrated a preferred embodiment of ground anchor 10 of the invention comprising an elongated stake member 12 and a support arm 16. Preferably the stake member is straight, as illustrated, having an upper end 11 and a sharpened lower end 13. The sharpened lower end is readily driven in to the ground by means of force applied to upper end 11 (e.g., through the use of a hammer).

The length of the stake member may vary, depending upon the depth to which it is desired to drive the stake into the ground. For example, the length may vary from about 12 inches to 60 inches. For most uses the length of the stake member is in the range of about 30 to 50 inches.

The lower portion of the stake member includes one or more wing members 14 which extend or project outwardly from the sides of the stake member. These wing members help to stabilize the lower portion of the stake member in the ground by increasing the effective surface area of the stake which pushes against the soil when pulling force is exerted on a cable attached to the front edge of the stake member.

The shape and size of the wing members may vary. Preferably the surface area of the wing member(s) is in the range of about 12 to 36 square inches.

On the front edge of the stake member there is carried an attachment member (i.e., means for attaching one end of a cable or the like to the stake member). The attachment means may be a hook, for example. The attachment means illustrated in the drawings is a bar 15 which is welded to the front edge of the stake member. The bar 15 preferably includes an opening 15A therein through which a hook 32 on the end of the cable 30 may be passed. Other types of attachement means may also be used.

The support arm 16 is attached at its upper end to the upper end of the stake member, as illustrated. Preferably the upper end of arm 16 is pivotably attached to the stake member by means of a pin or bolt 18. When the upper end of the stake includes an aperture or eyelet 22, and when the upper end of arm 16 includes an opening or aperture 17, the arm 16 may be pivoted to an outward position (as shown in FIG. 1) and then secured in that position by means of bolt or pin 20 extending through registering openings 17 and 22.

Figure 2:
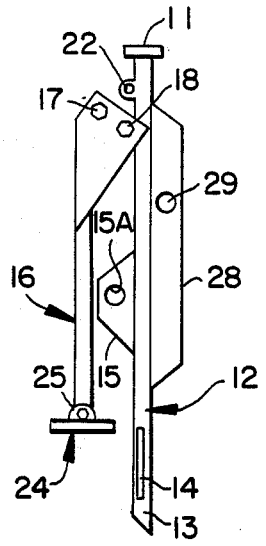
FIG. 2 is a side elevational view of a preferred embodiment of ground anchor of the invention.

When the pin or bolt 20 is removed the support arm 16 may be pivoted to an inward position adjacent to stake member 12 (as illustrated in FIG. 2). This enables the anchor to be folded or collapsed for storage or transport.

Figure 3:
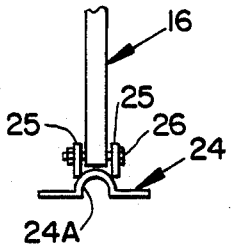
FIG. 3 is a front elevational view illustrating a preferred type of cable retention member on the lower end of the support arm of the anchor.
Figure 4:
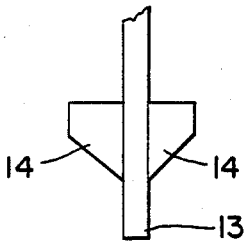
FIG. 4 illustrates useful wing members present on the lower end of the stake portion of the anchor.

The lower end of the support arm 16 includes retention means 24 which preferably comprises a plate member having a longitudinal groove or channel 24A therein, as best illustrated in FIG. 3. The plate 24 may be pivotably attached to the lower end of arm 16 by means of upstanding ears 25 and bolt or pin 26.

The support arm 16 extends outwardly and downwardly from the upper end of stake member 12 at an angle preferably in the range of about 15° to 45°. The lower end of the arm 16 is lower than the attachement means 15 on the front edge of the stake 12 where the end of cable 30 is attached (i.e., by hook 32). Thus, the support arm forces the cable 30 downwardly from the attachement point (as illustrated in FIG. 1). The groove or channel in the retention plate 24 assures that the cable 30 does not slip off the lower end of the arm 16.

The length of arm 16 may vary so long as the lower end of the arm is lower than the point of attachement of the cable to stake 12. Preferably, the length of arm 16 is in the range of about 18 to 24 inches.

The type of retention means may also vary. Although a plate member with a longitudinal channel is preferred, other types of retention means may also be used. For example, a plate member with downwardly extending pegs may be used. Also, a forked member may also be used.

When pulling force is applied to the cable 30, the arm 16 holds the cable downwardly so that the pulling force does not lift the stake out of the ground. This feature provides an anchor of significantly improved holding ability.

To assist in reinforcing the stake member 12 there preferably is a strap 28 welded to the rear edge of the stake 12, as illustrated. An aperture 29 in strap 28 enables a cable, chain etc. to be attached to the strap to facilitate pulling the stake member out of the ground from a reverse angle after the anchor has been used. Alternatively, an eyelet or hook may be used for this purpose.

Another advantage of this anchor system is that the user does not have to assemble it in order to use it.

Other variants are possible without departing from the scope of this invention.

What is claimed is:

1. A ground anchor for anchoring one end of a cable, said anchor comprising:

(a) an elongated stake member having upper and lower ends and front and rear edges; wherein said lower end includes a wing member projecting outwardly therefrom;

(b) attachement means permanently secured to said front edge of said stake member between said upper and lower ends; said attachement means being adapted to connect to said end of said cable;

(c) a support arm having first and second ends, wherein said first end is pivotally attached to said upper end of said stake member in a manner such that said support arm is pivotable between an inward position adjacent to said front edge of said stake member and an outward position away from said stake member;

(d) retention means carried by said second end of said support arm, wherein said retention means comprises a plate member which has upper and lower surfaces, wherein said upper surface is attached to said second end of said support arm and said lower surface includes a channel adapted to receive said cable;

wherein when said support arm is in said outward position and said lower end of said stake member is driven into the ground, said second end of said support arm is lower than said attachment means; whereby when said cable is attached to said attachment means and tension is applied to said cable, said cable is retained in said channel of said plate member.

2. An anchor in accordance with claim 1, wherein said attachment means comprises a plate having an opening therein.

3. An anchor in accordance with claim 1, further comprising lock means adapted to detachably lock said first end of said support arm to said upper end of said stake member when said support arm is in said outward position.

4. An anchor in accordance with claim 3, wherein said lock means comprises registering openings in said first end of said support arm and said upper end of said stake member and a pin which is adapted to be inserted into said registering openings when said support arm is in said outward position.

5. An anchor in accordance with claim 1, further comprising removal means carried by said rear edge of said stake member.

6. An anchor in accordance with claim 5, wherein said removal means comprises a strap secured to said rear edge of said stake member.

7. A folding ground anchor for anchoring one end of a cable, said anchor comprising:

(a) an elongated stake member having upper and lower ends and front and rear edges; wherein said lower end includes a wing member projecting outwardly therefrom transversely of said front and rear edges;

(b) attachement means permanently secured to said front edge of said stake member between said upper and lower ends; said attachement means being adapted to connect to said end of said cable;

(c) a support arm having first and second ends, wherein said first end is pivotally attached to said upper end of said stake member in a manner such that said stake member is pivotable between an inward position adjacent to said front edge of said stake member and an outward position away from said stake member;

(d) retention means carried by said second end of said support arm, wherein said retention means comprises a plate member which has upper and lower surfaces, wherein said upper surface is attached to said second end of said support arm and said lower surface includes a channel adapted to receive said cable;

wherein when said support arm is in said outward position and said lower end of said stake member is driven into the ground, said second end of said support arm is lower than said attachment means; whereby when said cable is attached to said attachement means and tension is applied to said cable, said cable is retained in said channel of said plate member.

8. An anchor in accordance with claim 7, wherein said attachment means comprises a plate having an opening therein.

9. An anchor in accordance with claim 7, further comprising lock means adapted to detachably lock said first end of said support arm to said upper end of said stake member when said support arm is in said outward position.

10. A ground anchor system for anchoring one end of a cable to the ground, said anchor system comprising:

(a) an elongated stake member having upper and lower ends and front and rear edges; wherein said lower end includes a wing member projecting outwardly therefrom;

(b) attachment means permanently secured to said front edge of said stake member between said upper and lower ends; said attachment means being adapted to connect to said end of said cable;

(c) a support arm having first and second ends, wherein said first end is attached to said upper end of said stake member and said second end projects outwardly and downwardly from said upper end of said stake member;

(d) retention means carried by said second end of said support arm, wherein said retention means comprises a plate member which has upper and lower surfaces, wherein said upper surface is attached to said second end of said support arm and said lower surface includes a channel adapted to receive said cable;

wherein when said lower end of said stake member is driven into the ground said second end of said support arm is lower than said attachement means; whereby when said cable is attached to said attachement means and tension is applied to said cable, said cable is retained in said channel of said plate member.

11. An anchor system in accordance with claim 10, wherein said first end of said support arm is pivotally attached to said upper end of said stake member in a manner such that said support arm is pivotable between an inward position adjacent to said front edge of said stake member and an outward position away from said stake member.

12. An anchor system in accordance with claim 11, further comprising lock means adapted to detachably lock said first end of said support arm to said upper end of said stake member when said support arm is in said outward position.

13. An anchor system in accordance with claim 12, wherein said lock means comprises registering openings in said first end of said support arm and said upper end of said stake member and a pin member which is adapted to be inserted into said registering openings when said support arm is in said outward position.

14. An anchor system in accordance with claim 10, further comprising removal means carried by said rear edge of said stake member for pulling said stake member out of the ground.

15. An anchor system in accordance with claim 14, wherein said removal means comprises a strap secured to said rear edge of said stake member.

* * * * *